US005487433A

United States Patent [19]

Mackay et al.

[11] Patent Number: 5,487,433

[45] Date of Patent: Jan. 30, 1996

[54] CORE SEPARATOR ASSEMBLY

[75] Inventors: Bruce W. Mackay, Sugar Land; Abbas Arian, Houston, both of Tex.

[73] Assignee: Westers Atlas International Inc., Houston, Tex.

[21] Appl. No.: 373,654

[22] Filed: Jan. 17, 1995

[51] Int. Cl.[6] ..... E21B 25/02

[52] U.S. Cl. ..... 175/78; 175/250; 175/254

[58] Field of Search ..... 175/78, 249, 250, 175/254, 58, 79, 80, 81, 82

[56] References Cited

U.S. PATENT DOCUMENTS

| | | | |
|---|---|---|---|
| 1,683,642 | 9/1928 | Williston | 175/77 |
| 2,181,980 | 12/1939 | Seale | 175/78 |
| 3,630,296 | 12/1971 | Bullard | 175/77 |
| 4,396,074 | 8/1983 | Jageler et al. | 175/78 |
| 4,449,593 | 5/1984 | Jageler et al. | 175/58 |
| 4,466,495 | 8/1984 | Jageler | 175/78 X |
| 4,714,119 | 12/1987 | Hebert et al. | 175/20 |
| 5,310,013 | 5/1994 | Kishino et al. | 175/44 |
| 5,411,106 | 5/1995 | Maissa et al. | 175/78 |

*Primary Examiner*—Frank S. Tsay
*Attorney, Agent, or Firm*—William A. Knox

[57] ABSTRACT

An assembly for dispensing a core separator ring on the top of a previously-cut core that is ejected from a core-cutting bit in a storage bin. The core separator assembly is integral with the forward end of the core ejector system.

4 Claims, 4 Drawing Sheets

CORE SEPARATOR ASSEMBLY

BACKGROUND OF THE INVENTION

1. Field of the Invention

This invention is concerned with a wireline tool for cutting, retrieving and separating retrieved sidewall core samples from a borehole.

2. Discussion of Related Art

Core samples are plugs of the native rock cut from the rock formations at depth levels of interest. The structure, composition and texture of the rock formations as evidenced by the core samples are of quantitative analytical interest to miners, civil engineers, petrophysicists, geologists, oceanographers and other earth scientists.

Boreholes penetrating the earth are drilled for many different purposes, such as water wells, oil and gas wells, brine recovery wells, and foundation studies. Ordinarily, the drilling process particulates and contaminates the rock formations that are penetrated by the drill so that the drill cuttings themselves are of limited use analytically. For that reason, special tools have been developed for cutting cores from the living rock at selected depth levels, often in the borehole sidewall after the borehole has been drilled.

In days of yore, a plurality of hollow punch-core bits were loaded in barrels mounted in an elongated coring tool. The bits are aimed perpendicularly to the borehole sidewall and distributed at selected intervals longitudinally along a mandrel one or two tens of feet long. Each of the bits was secured to the mandrel by a short flexible cable. The mandrel comprising the coring tool was lowered to a desired depth from a wireline whereupon explosive charges were triggered behind the respective core bits, driving them into the sidewall. A core sample was retained in the hollow bit after detonation. The coring tool was then recovered from the borehole after breaking loose from the sidewall, the plurality of punch-core bits and heir contained core samples. Verification of the core sequence was assured because each core was resident in a physically separate core bin which was secured to the coring tool by the attached cable so that the relative depth of each core in the sequence was positively known. A missing core was readily detectable by simple inspection.

There were problems with explosively-driven punch-coring tools, not the least of which was the need for use of explosives, a hazardous proposition.

A different type of wireline coring tool is in use that employs a hollow rotary coring bit that is mounted in a housing fitted in the mandrel of a down-hole wireline coring tool. The housing comprises an assembly including means for laterally extending a rotating cutting bit into, and retracting the bit from a borehole sidewall. Upon retraction, following the core-cutting operation, the bit is rotated 90° whereupon a push rod shoves the cut core out of the bit into a storage tube. The storage tube is mounted longitudinally with respect to the mandrel, beneath the housing containing the cutting bit. A typical sidewall core is about an inch in diameter and about one-and-one half to two inches long. After the first core is cut, the coring tool is moved up the borehole to a new location where another core is cut and stored in the core storage tube. The process is repeated until the storage tube is full, perhaps acquiring twenty or more cores per downhole trip.

One such arrangement is taught in U.S. patent application Ser. No. 08/146,441, filed Oct. 29, 1993 in the name of Jacques Maissa et al., assigned to the assignee of this invention, and now U.S. Pat. No. 5,411,106, issued May 2, 1995, which is incorporated herein by reference.

It is preferable that the respective cores residing in the storage tube be physically separated from one another. Additionally, completion of a particular sidewall coring operation does not necessarily result in successful recovery of a core. Therefore the core sequence must be properly indexed such the non-existence of one or more cores can be positively verified.

U.S. Pat. No. 5,310,013, issued May 10, 1994 to A. C. Kishino et al. discloses means for placing an indexing marker above each recovered core. No indication of a missing core appears to be provided for.

U.S. Pat. No. 4,714,119, issued Dec. 22, 1987 to Joel Hebert et al. also provides means for inserting a marker disc between the recovered cores. Both of the above patents employ a tubular reservoir of marker discs that are urged upwards by a pusher spring. A separate tubular core storage bin is mounted beside to marker reservoir. After a core is deposited in the core storage bin, a system of levers shoves a marker disc laterally from the open upper end of the marker reservoir to the mouth of the storage bin. Somehow a magnetic solenoid at the top of the storage bin, captures the marker disc (which is magnetic) so that it will fall on top of the previously-deposited core. The mechanical arrangement of the two references is deemed to be far too complicated to be practical.

U.S. Pat. No. 4,449,593, issued May 22, 1984, to Gary D. Bruce et al. also teaches use of indexing washers to separate core samples. Here again, Bruce's system involves a separate storage bin for the marker discs and a lever system for shoving the marker into the core storage bin.

In all three of the above patent references, the marker disc must in some way fall into place rather than be firmly deposited in place.

There is a need for a mechanically simple, reliable means for positively dispensing core a separator between individual cores during a core storage operation.

SUMMARY OF THE INVENTION

This invention provides a novel core separating assembly in combination with a sidewall coring tool. The novel combination includes a hollow core-cutting bit that may be disposed in either a core cutting position or in a core storage position. When the core cutting bit is in the core storage position, a hydraulically-actuated core ejector executes a core ejection stroke to push the core from the core cutting bit into a core storage tube. The leading end of the core ejector includes a hydraulically-operated, integral core separator assembly. The core separator assembly consists of a mandrel over which a plurality of separator rings are concentrically stacked. After a core has been deposited in the core storage tube, a cam means releases a single core separator ring for positive disposition on top of the deposited core before the core ejector executes a return stroke prior to disposing the cutting bit to the core cutting position. The process is repeated a plurality of times until the plurality of stacked core-separator rings is exhausted.

BRIEF DESCRIPTION OF THE DRAWINGS

The novel features which are believed to be characteristic of the invention, both as to organization and methods of operation, together with the objects and advantages thereof, will be better understood from the following detailed description and the drawings wherein the invention is illustrated by way of example for the purpose of illustration and description only and are not intended as a definition of the limits of the invention.

DETAILED DESCRIPTION OF THE PREFERRED EMBODIMENT

Figure 1:
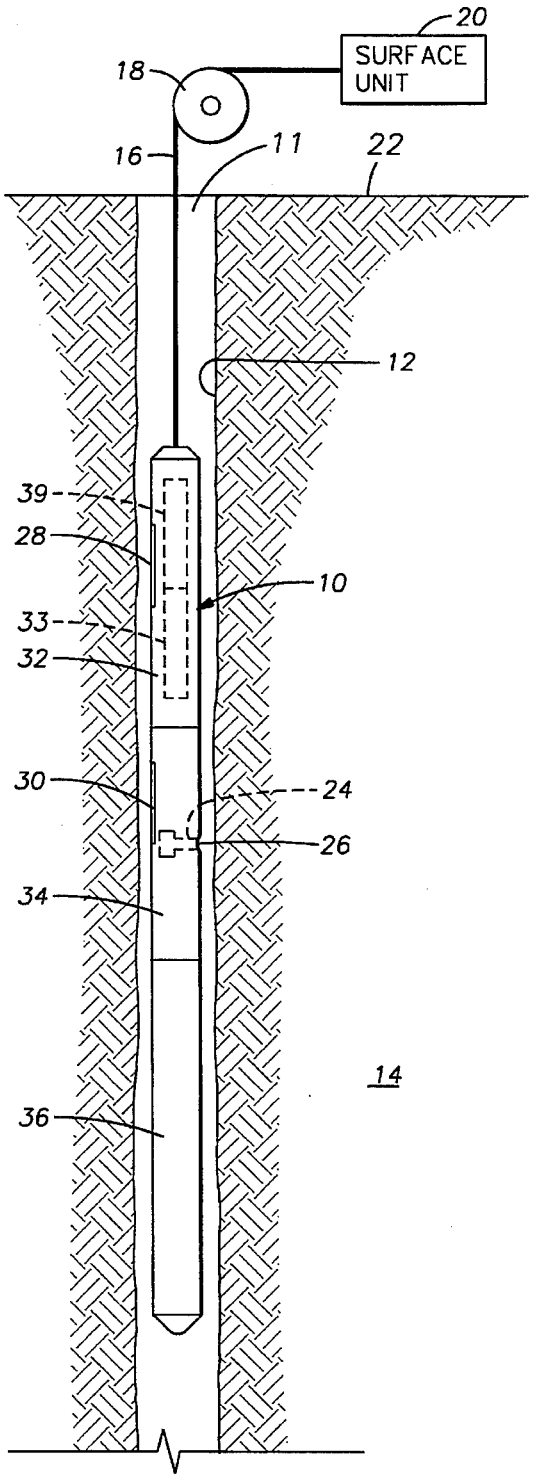
FIG. 1 shows the general configuration of a wireline coring tool in a borehole with a core cutting bit retracted.
Figure 2:
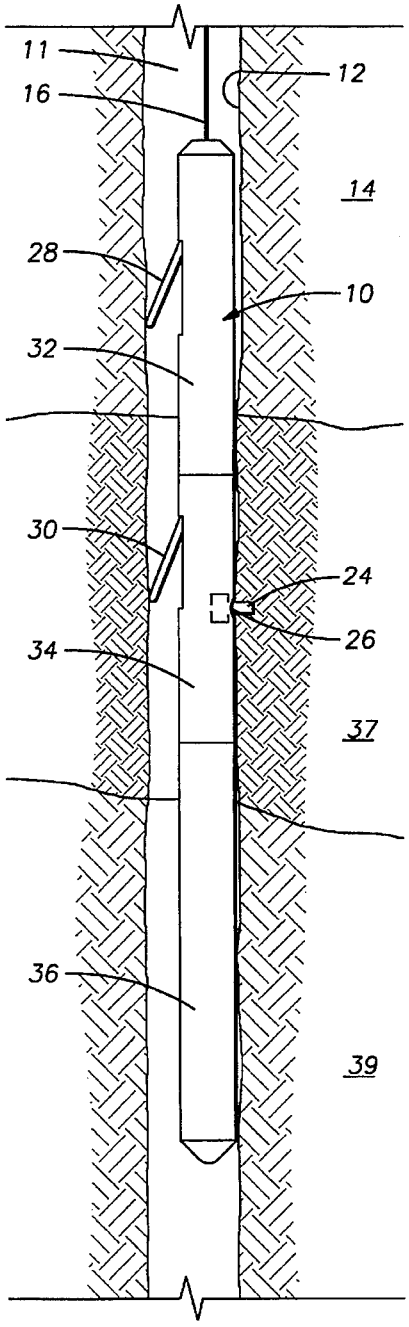
FIG. 2 illustrates the coring tool with the tool locked in place and with a core-cutting bit extended.

FIG. 1 shows a coring tool 10 suspended in a borehole 11, having a sidewall 12 in a selected earth formation 14, from a wireline 16 engaging a sheave 18 associated with a surface control unit 20 on the surface of the earth 22. Surface unit 20 includes means for controlling and programming the necessary functions of coring tool 10 by sending electronic signals through a standard 7-conductor-plus-stress-member logging cable 16 as is well known to the art. Coring tool 10 includes a core cutting bit 24, shown in the retracted position from bit opening 26 in the core cutting tool. Coring tool includes caliper arms 28 and 30 for locking the tool against the sidewall 12 of a borehole 11 as shown in FIG. 2. Coring tool 10 may include separate sections such as 32 wherein is contained electronics control modules 33 as well as means 35 for providing hydraulic power for operating the caliper arms 28 and 30, core cutting bit 24 and other equipment to be explained later. Section 34 includes the mechanisms that control the functions of the core cutting bit and core ejector assemblies. Section 36 may include ancillary equipment, none of which is pertinent to this disclosure.

FIG. 2 shows coring tool 10 locked in position opposite an earth formation 3 of interest and above an uninteresting earth formation 39. Core cutting bit 24 is shown extended laterally through bit opening 26 in the side of coring tool 10 to cut a core from formation 37.

Figure 3:
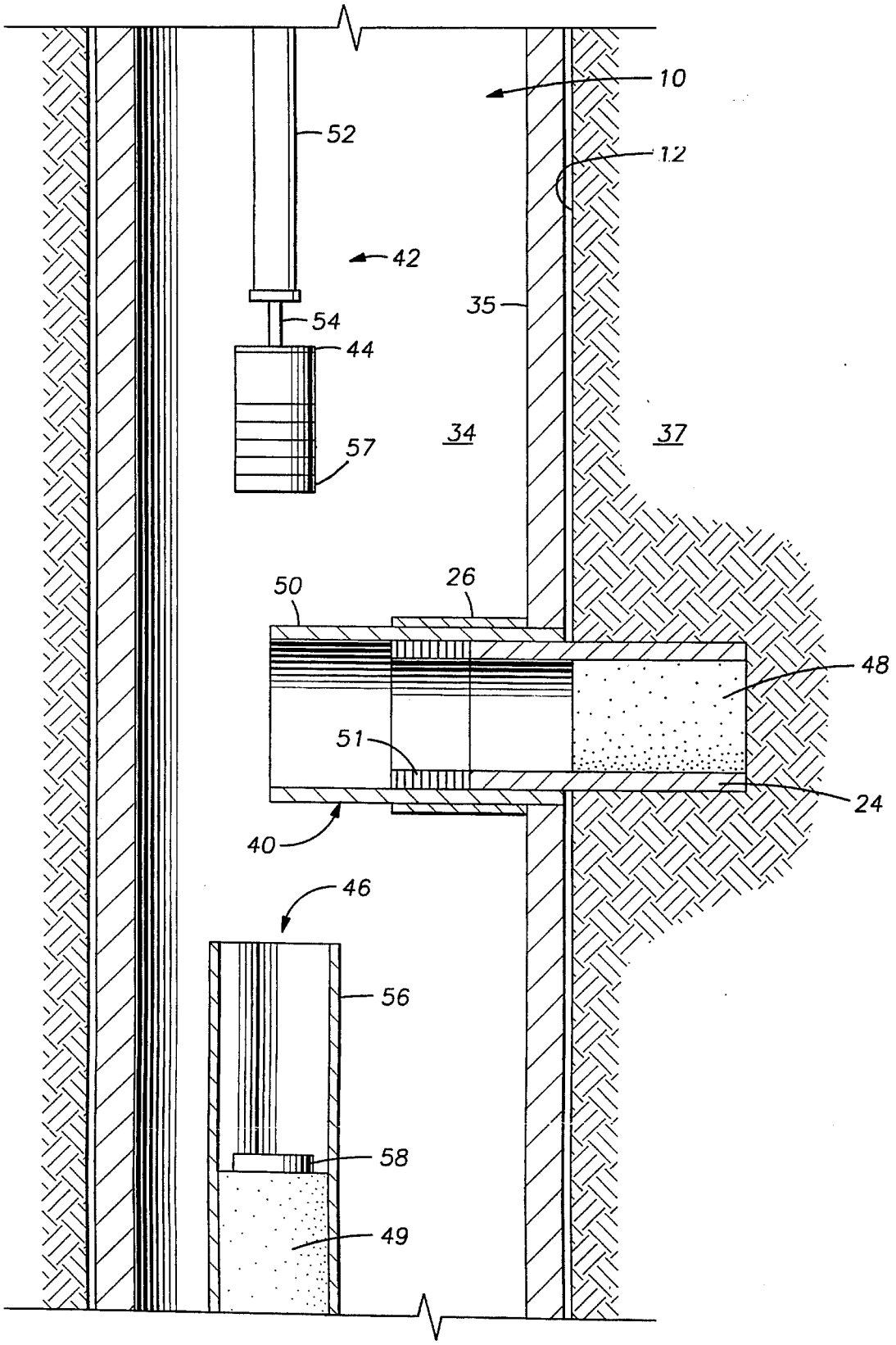
FIG. 3 is a detailed schematic drawing of the core cutting bit extended and cutting a sidewall core.
Figure 4:
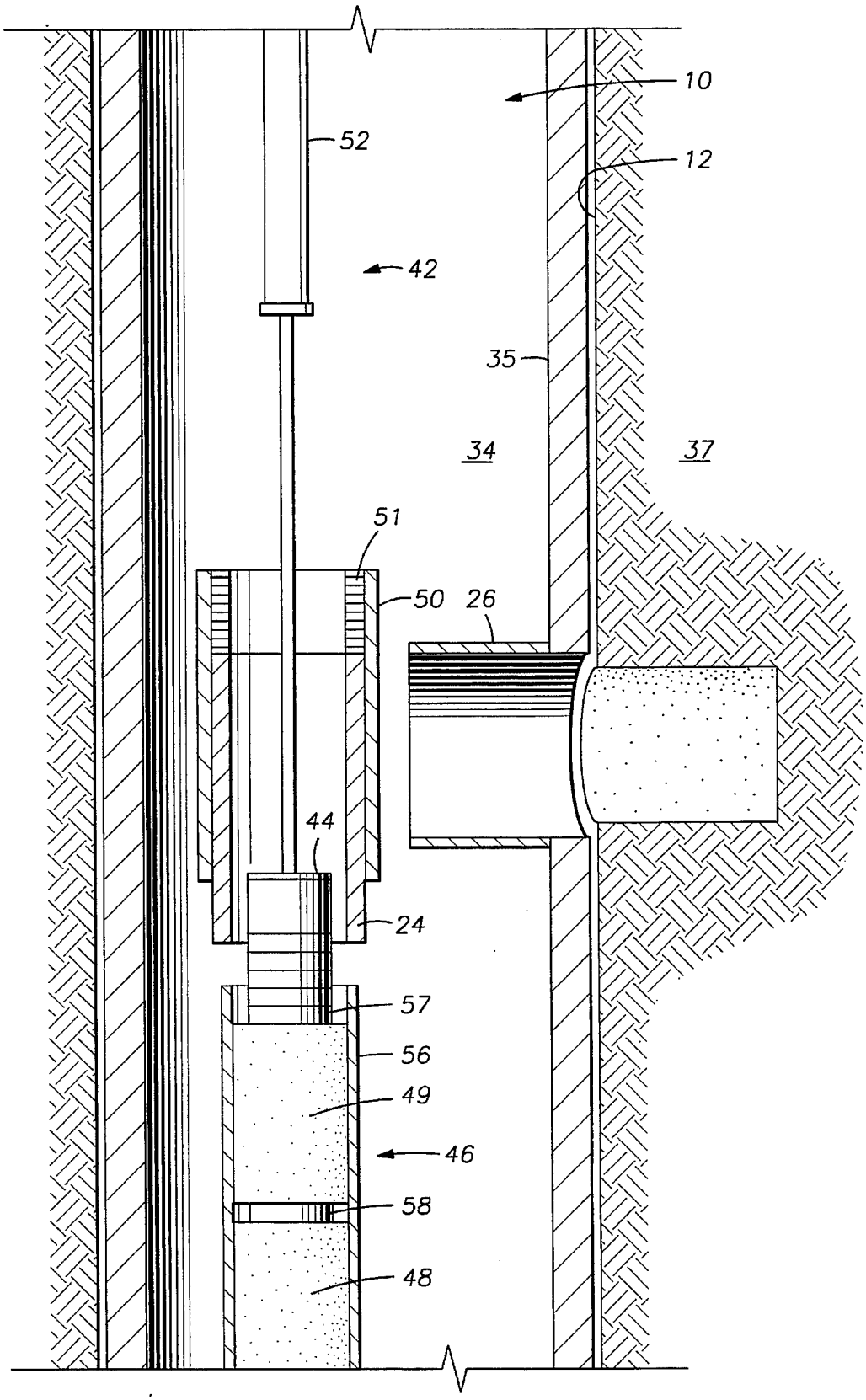
FIG. 4 is a schematic illustration of the core ejector pushing a core from the core cutting bit into a storage bin.

Please refer now to FIGS. 3 and 4 which taken together are intended to show the general schema of the core-cutting/core-storage bit-position mechanization to show how the core separator assembly of this invention interacts in combination with a core-cutting operation. A detailed mechanical exegesis of the bit extension and bit retraction system itself, usually some form of slotted cam-plate arrangement as taught by any one of the references earlier cited, is not presented here to avoid prolixity and undue complexity of the drawings since such details are not germane to this invention.

FIGS. 3 and 4 represent a longitudinal cross section of section 34 of coring tool 10 showing the core cutting bit assembly 40, the core ejector assembly 42, the core separator assembly 44 and the core storage bin 46, all resident inside the cylindrical wall 39 of section 34.

In FIG. 3, the cutting bit assembly 40 is shown in the core-cutting position, extending through bit opening 26 where a core 48 is being cut from earth formation 37. The core ejector assembly 42 is withdrawn. The core-cutting bit assembly 40 includes bit 24, a bit housing 50 and a hollow hydraulically or electrically operated motor and transmission means, symbolically shown as 51, for rotating coring bit 24 during core-cutting operations.

Core ejector assembly 42 includes a double-acting hydraulic cylinder 52, piston rod 54 and core separator assembly 44 which is integral with the forward end of the ejector as represented by the core ejector piston rod 54. Core separator assembly 44 includes a number of separator rings, the lowermost of which is designated by the reference numeral 57. Further details of core separator assembly 44 will be explained in detail later in connection with FIGS. 5–7. As also will be explained later, certain members internal to core separator assembly 44 are in fluid communication with pressurized hydraulic fluid provided by hydraulic source 35 to cylinder 52 in core separator assembly 44 via a passageway in piston rod 54.

Core storage bin 46 is a tube 56 of suitable length to hold a plurality of cores; the tube has a diameter commensurate with the diameter of the cut cores. Tube 56 is shown holding a previously-cut core 49, upon the top of which reposes a core separator ring 58 that was positively deposited thereon from a previous core-cutting cycle.

In FIG. 4, after a core 48 has been cut and broken loose from formation 37, cutting bit assembly 40 is retracted from the core-cutting position and rotated to the core-storage position by means not shown, with the core assembly disposed vertically, that is, parallel to the longitudinal axis of coring tool 10, over the core storage bin 46. Assuming that the core material is not friable, the newly-cut core 48 is frictionally retained in the core-cutting bit by a retaining ring (not shown) during the bit retraction cycle. After the core cutting bit assembly is in the core-storage position, core ejector 42 is activated by the surface control system 20 to extend piston rod 54 with the core separator assembly 44 integral with the forward end thereof, thereby to push the cut core 48 out of bit 24 and into storage bin 46 on top of the previously-cut core 49 and core separator ring 58. After core ejection, but before core ejector piston rod 54 is retracted., the hydraulic system that operates cylinder 52 is slightly over-pressured to cause core separator assembly 44 to positively deposit the lowermost separator ring 57 directly on the top of core 48. By use of that stratagem, that is, by direct positive deposit, the separator ring is not obliged to tumble down by gravity free-fall through viscous drilling mud in storage tube 56 before coming to rest, perhaps awry, on a core sample far below in the storage tube, as was done in known prior-art tools.

Figure 5:
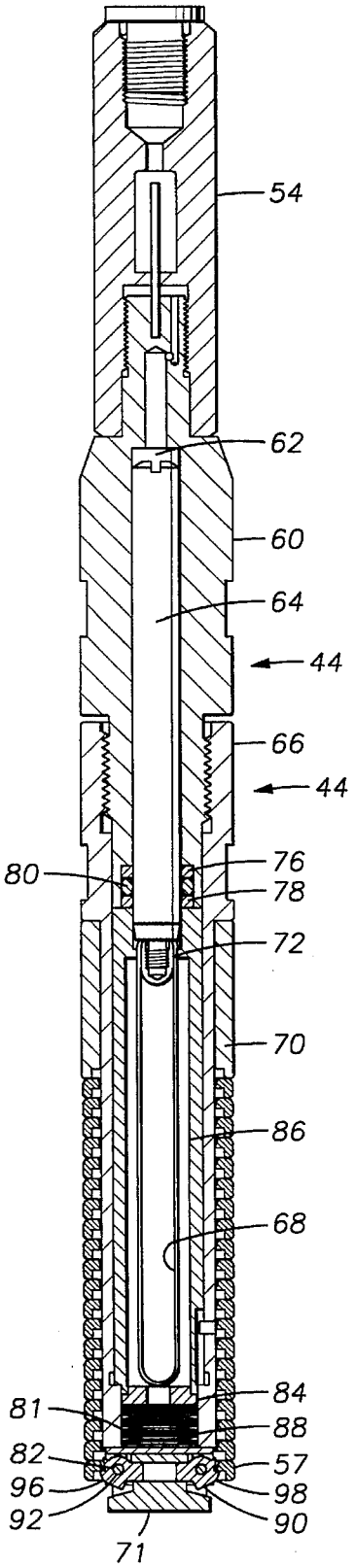
FIG. 5 is a detailed showing of the core separator assembly.
Figure 6:
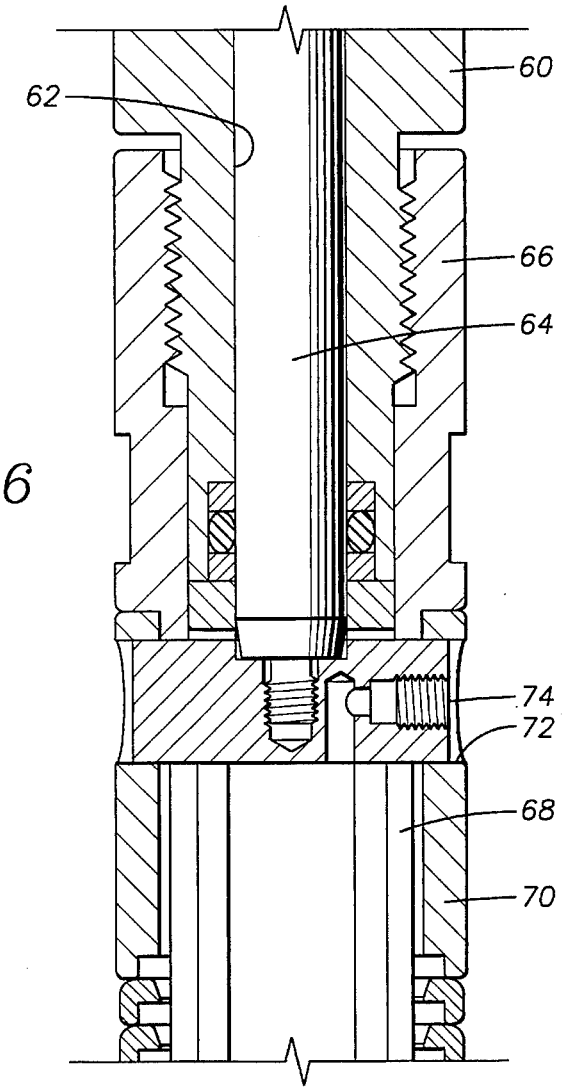
FIG. 6 is a cross section of FIG. 5 along line 6—6.

Please now refer to FIGS. 5 and 6. Core separator assembly includes a compression sub 60 having an internal pressure chamber 62 for containing an actuator rod 64. Compression sub 60 is threadedly coupled to core separator mandrel 66 that has a longitudinal slot 68 cut along a portion of its length. The mandrel is terminated by an end plate 71. An actuator ring 70 is mounted externally around mandrel 66 with a sliding fit. A guide pin 72, into which the forward end of actuator rod 64 is screwed, transfers the motion of the internally-mounted actuator rod 64 to the externally mounted actuator ring 70 through slot 68. A grease fitting 74 is provided for lubrication. 0-rings 76 and 78 along with 0-ring backup 80 seal compression chamber 62 around actuator rod 64.

At the right-hand end of core separator assembly 44, that is, at the forward end, a stack of Belleville springs 81 are mounted between spring plate 82 and spacer end cap 84. The Belleville springs are held in place by spacer 86 that is mounted interiorly to mandrel 66 and pressed snugly against the springs 81 by compression sub 60. The springs are separated by thin washers such as 88.

Figure 7:
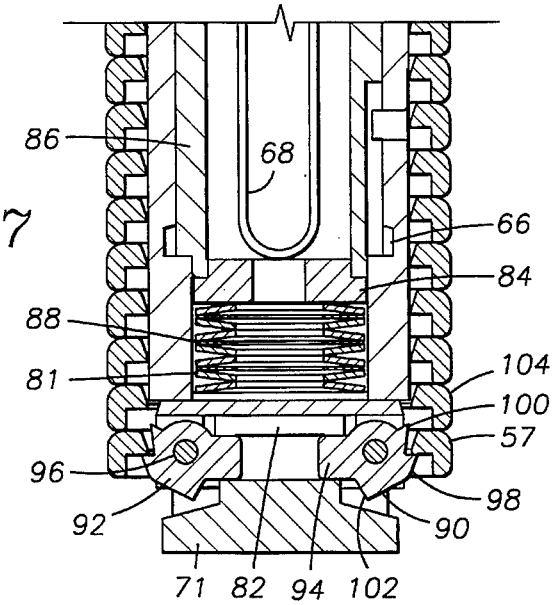
FIG. 7 is an enlargement of a portion of FIG. 5 showing details of the core separator sprockets.

Referring now to FIGS. 5 and 7, the right hand forward end of mandrel 66 includes a pair of sprockets 90 and 92 that are mounted on opposite sides of the forward end of the mandrel 66. Since the sprockets are substantially identical, only one will be described in detail with particular reference to the enlarged drawing of FIG. 7. The sprockets each have a cam member such as 94 that is loaded by the force of the Belleville springs 81 through spring plate 82. The sprockets are rotatable about axes such as 96 that are transverse to the longitudinal axis of the mandrel. The sprockets 90 and 92 each have a first tooth such as 98 and a second tooth such as 100. A plurality of core separator rings, of which the lowermost ring is shown as 57, are stacked externally around the mandrel, using a generous sliding fit, between the sprockets 90 and 92 and actuator ring 70. The core separator rings are held in place by the first tooth such as 98 of each of the sprockets 90 and 92 while the sprockets are in the cocked position.

In a presently preferred embodiment, mandrel 66 has a capacity for 20 separator rings.

Spring-loaded cam member such as 94 of each sprocket normally maintains the sprockets in the cocked position as shown, against the hydraulic pressure that may be resident in compression sub 60. The spring force is adjusted to exceed, by a small selected increment, the total force exerted by actuator piston rod 64 at normal system operating pressure. At the normal system operating pressure of 2000 psi, the force exerted by the piston is about 80 pounds. The spring force is adjusted by adding or removing one of the Belleville springs or by adjusting the length of spacer 86 or both.

In the best mode of operation, to deposit a separator ring on a previously-ejected and stored core, the hydraulic pressure applied to actuator rod 64 is raised to the relief pressure of 2300 psi, thus allowing actuator piston 64 to exert an applied force increment of about 10 pounds. Actuator piston, through guide pin 72 and actuator ring 70 pushes lowermost separator ring 57 against the first tooth 98 of sprocket 90 and similarly for sprocket 92. The force applied to core separator ring 57 causes the sprockets to rotate because the applied force overcomes the opposing force exerted by the spring-loaded cam member 94 of sprocket 90 and similarly for sprocket 92. Rotation of the sprockets causes the first tooth to retract, thereby allowing lowermost separator ring to be released from mandrel 66. At the same time, second tooth 100 emerges to trap the next separator ring in line, 104. No additional amount of incremental force will allow the sprockets to rotate further because a stop surface of a sprocket such as 102 contacts the inner edge of end plate 71 and therefore can rotate no farther. Therefore only one ring at a time is released by core separator assembly 44. Release of the incremental pressure, allows the spring system 81 to recock itself for a new cycle.

To continue the best mode of operation, following a complete cycle of core cutting, core ejection and core storage, the core cutting tool is ready to be moved to a new location up the borehole by first releasing caliper arms 28 an 30 (FIGS. 1 and 2). At the new location, the caliper arms are again extended. At that time, the afore-mentioned over pressuring operation is performed to positively deposit a separator ring on the stored core. The core ejector 42 is then withdrawn preparatory for a new core-cutting cycle. That particular sequence of operations is preferred because, in the event that a core is not recovered for some reason, the cycle of events just enumerated will still take place but with the result that two separator rings instead of one will be deposited on the previously-stored core. In that manner, the operators have positive knowledge of the depth sequence of the respective cores.

The novel features of this invention have been described with a certain degree of particularity by way of example but not by way of limitation. Variations of this invention will become apparent to those skilled ion the art but which will fall within the scope and spirit of this invention which is limited only by the appended claims.

What is claimed is:

1. A core collector mounted on a coring tool for use in a borehole, comprising in combination:

a hollow core cutting bit having a borehole sidewall core-cutting position and a core-storage position;

a core ejector means;

means for causing said core ejector means sequentially 1) to execute an ejecting stroke to eject a core from said core cutting bit into a core storage means when said core cutting bit is disposed in the core-storage position and 2) to positively deposit a core separator ring on top of the ejected core prior to executing a withdrawal stroke.

2. The core collector as defined by claim 1, comprising:

a core-separator assembly means integral with the leading end of said core ejector, said core separator assembly including a plurality of separator rings slidingly concentrically stacked on a mandrel;

a cam means for depositing a single separator ring from said mandrel onto an ejected core prior to said core ejector executing a withdrawal stroke before disposal of said core-cutting bit in a subsequent core-cutting position.

3. The core collector as defined by claim 2, comprising:

means for repeatedly causing said core-cutting bit to assume the core-cutting and the core-storage positions in alternate cycles at a plurality of different locations in the borehole and to execute the core-ejection, core-storage and core separator ring deposition sequence at each of the different locations until the plurality of stacked separator rings is exhausted.

4. For use with a borehole sidewall coring tool, a core ejector piston for pushing a core sample from a core-cutting bit into a storage bin, comprising:

a compression sub integral with the leading end of said core ejector piston;

a mandrel having a forward end, coupled to said compression sub;

a piston actuator rod, disposed internally of said compression sub and said mandrel, operatively coupled to an actuator ring, said actuator ring being mounted for external axial motion along said mandrel;

a pair of sprockets each having a first tooth, a second tooth and a spring-loaded cam member, the sprockets being mounted on opposite sides of the forward end of said mandrel, the rotational axis of each said sprocket being transverse to the longitudinal axis of said mandrel;

a plurality of separator rings slidingly stacked between said actuator ring and the first tooth of each said sprocket, there being at least a lowermost separator ring;

means for applying hydraulic pressure to said piston actuator rod to cause said actuator ring to press the lowermost separator ring against the first tooth of said sprockets causing said sprockets to rotate until the opposing force of the spring-loaded cams is overcome so that the lowermost separator ring is dispensed while the second of said sprocket teeth trap the separator ring next in line along the mandrel.

* * * * *